United States Patent [19]

Andis

[11] 4,328,616

[45] May 11, 1982

[54] LAMINATED HAIR CLIPPER BLADE SET

[75] Inventor: Matthew L. Andis, Racine, Wis.

[73] Assignee: Outboard Marine Corporation, Waukegan, Ill.

[21] Appl. No.: 96,784

[22] Filed: Nov. 23, 1979

Related U.S. Application Data

[63] Continuation-in-part of Ser. No. 916,511, Jun. 19, 1978, Pat. No. 4,249,307.

[51] Int. Cl.[3] ..... B26B 19/06

[52] U.S. Cl. ..... 30/225; 30/216; 30/220

[58] Field of Search ..... 30/220, 223, 216, 224, 30/210, 225, 221, 222

[56] References Cited

U.S. PATENT DOCUMENTS

| | | | |
|---|---|---|---|
| 1,956,042 | 4/1934 | Oster | 30/221 |
| 2,182,597 | 12/1939 | Oster | 30/210 |
| 2,704,887 | 3/1955 | Andis | 30/210 |
| 2,790,236 | 4/1957 | Andis | 30/210 |
| 3,101,535 | 8/1963 | Andis | 30/223 |
| 3,222,781 | 12/1965 | Luther et al. | 30/210 |
| 3,992,778 | 11/1976 | Urbush | 30/216 |
| 4,249,307 | 2/1981 | Andis | 30/216 |

FOREIGN PATENT DOCUMENTS

| | | | |
|---|---|---|---|
| 271151 | 3/1914 | Fed. Rep. of Germany | 30/223 |

*Primary Examiner*—Roscoe V. Parker

*Attorney, Agent, or Firm*—Michael, Best & Friedrich

[57] ABSTRACT

A hair clipper blade set comprises a fixed blade assembly having a forward edge with a series of teeth extending therealong and a movable blade assembly having a forward edge with a series of teeth extending therealong. The movable blade assembly is supported against the fixed blade assembly for reciprocative movement across the fixed blade assembly with the teeth of the movable blade assembly operatively cooperating with theteeth of the fixed blade assembly to cut hair. The fixed blade assembly is of laminated two-piece construction and includes a molded blade carrier and a machined blade member, the carrier and blade being secured together in assembled relation. The laminated fixed blade assembly may be generally T-shaped in construction to permit use of the blade set within relatively confined areas, such as the nostrils or ears, to remove superflous hair. In this construction, the associated movable blade assembly is likewise T-shaped, and may also be of laminated construction.

1 Claim, 6 Drawing Figures

Fig. 1
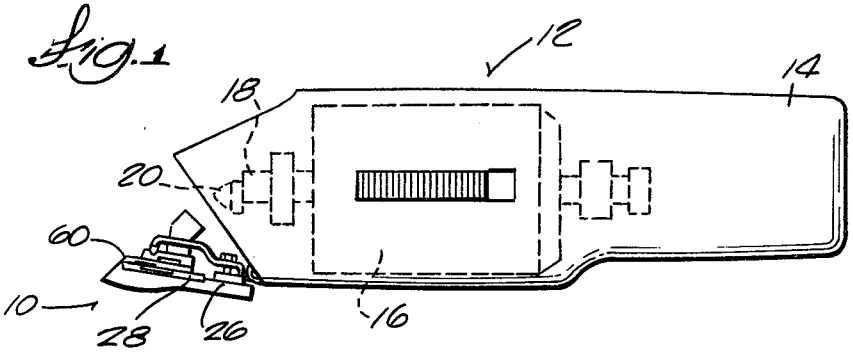
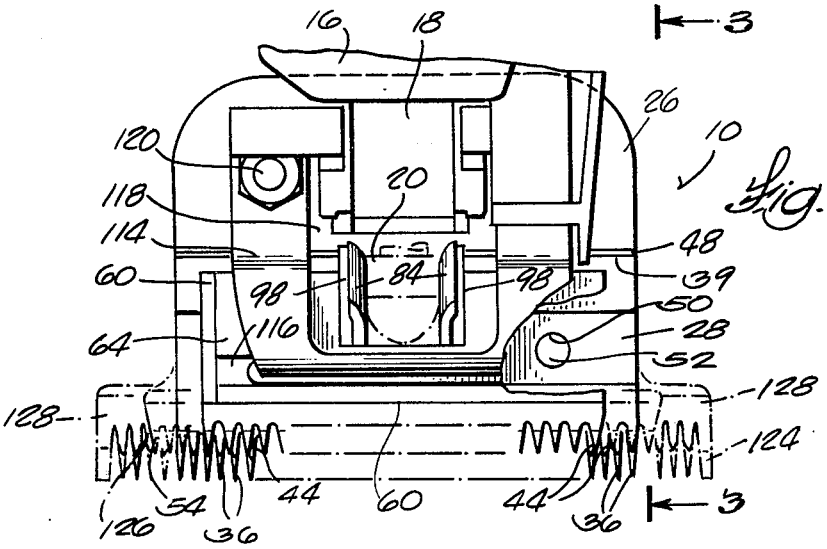
Fig. 2
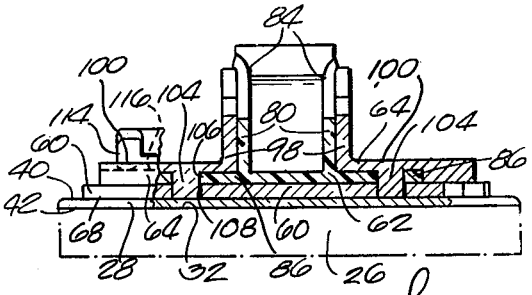
Fig. 4
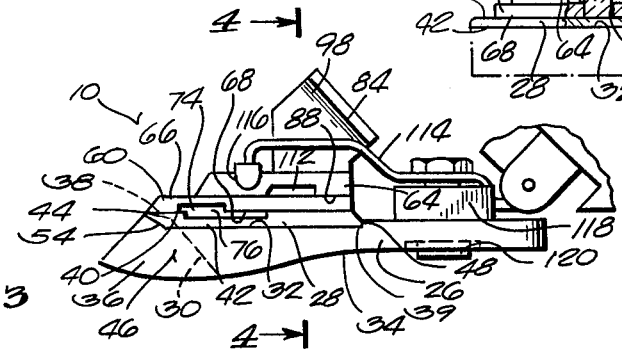
Fig. 3

LAMINATED HAIR CLIPPER BLADE SET

RELATED APPLICATIONS

This application is a continuation-in-part of my copending application Ser. No. 916,511 filed June 19, 1978 entitled "Hair Clipper" now U.S. Pat. No. 4,249,307.

FIELD OF THE INVENTION

The invention generally relates to blade sets used in combination with electrically operated hair clippers. The invention also relates to T-shaped blade sets.

DESCRIPTION OF THE PRIOR ART

Attention is directed to the following U.S. patents which disclose blade sets adapted for operative attachment with electrically operated hair clippers.

Oster; U.S. Pat. No. 1,956,042; Apr. 24, 1934
Oster; U.S. Pat. No. 2,182,597; Dec. 5, 1939
Andis; U.S. Pat. No. 2,704,887; Mar. 29, 1955
Andis; U.S. Pat. No. 2,790,236; Apr. 30, 1957
Andis; U.S. Pat. No. 3,101,535; Aug. 27, 1963
Luther et al; U.S. Pat. No. 3,222,781; Dec. 14, 1965
Urbush; U.S. Pat. No. 3,992,778; Nov. 23, 1976

SUMMARY OF THE INVENTION

The invention provides a blade assembly operative as a shear plate for a hair clipper blade set. The blade assembly is of laminated construction and comprises a blade carrier and a blade member having a forward edge. A series of teeth outwardly projects from the blade member forward edge. Means is provided for securing the blade carrier and the blade member together in assembled relation. This laminated, two-piece construction facilitates the manufacture of the blade assembly. It also leads to an overall reduction in the weight of the blade assembly as well as insulates the associated blade member from heat and/or electricity.

In one embodiment of the invention, the blade carrier and blade member are detachably secured together in assembled relation. Thus, the blade member may be conveniently separated from the blade carrier for cleaning, sharpening, or replacement.

In one embodiment of the invention, the blade carrier includes a forward edge, and the blade assembly further includes a series of comb teeth outwardly projecting from the forward edge of the blade carrier. When the blade member and the blade carrier are in assembled relation, the teeth of the blade member generally overlie the comb teeth.

In one embodiment of the invention, the securing means includes at least one opening formed in either the blade member or the blade carrier and at least one pin projecting from the other one of the blade member and the blade carrier, with the number of the pins being at least equal to the number of the openings. The pins are engaged in the openings when the blade member and the blade carrier are in proper assembled relation.

In one embodiment of the invention, the blade carrier includes an upper surface extending from the forward edge, and the blade member includes a rearward edge spaced from its forward edge. The securing means includes a rearward shoulder which projects from the upper surface of the blade carrier in a spaced and parallel relation with the forward edge of the blade carrier. The rearward shoulder engages the rearward edge of the blade member when the blade member and the blade carrier are in proper assembled relation.

In one embodiment of the invention, the blade carrier includes a lower surface extending from the forward edge and spaced from the upper surface. Similarly, the blade member includes top and bottom surfaces which extend from its forward edge. In this embodiment, the forward edge of the blade carrier slopes from the lower surface in a forward direction toward the upper surface, and the forward edge of the blade member likewise slopes from its bottom surface in a forward direction toward its top surface. When the blade carrier and the blade member are in assembled relation, the sloping forward edges of the blade carrier and blade member are aligned to form a uniformly sloped forward edge for the blade assembly.

In one embodiment of the invention, the blade carrier and the associated blade member are each generally T-shaped. This construction leads to an overall reduction in the weight of the blade assembly and a savings in material.

The invention also provides a blade assembly operative as a movable blade assembly for a hair clipper blade set. The blade assembly includes a generally T-shaped blade member, a yoke member, and a shoe member which are detachably secured together in assembled relation. This construction permits convenient separation of the blade member from the yoke member and shoe member for cleaning, sharpening, or replacement.

The invention also provides a hair clipper blade set comprising a fixed blade assembly of two-piece, laminated construction as heretofore described as well as an associated movable blade assembly having teeth. The movable blade assembly is supported against the fixed blade assembly for reciprocative movement across the fixed blade assembly with the teeth of the movable blade assembly operatively cooperating with the teeth of the fixed blade assembly to cut hair.

In one embodiment of the blade set invention, the movable blade assembly is of three-piece laminated construction and includes a blade member, a yoke member and a shoe member which are detachably secured together in assembled relation.

In one embodiment of the blade set invention, both the laminated fixed blade assembly and the associated movable blade assembly are generally T-shaped. The T-shaped permits use of the blade set in confined areas, such as the nostrils or ears, to remove superfluous hair. It also permits the operator to better see the cutting area and facilitates the free fall of hair from the cutting area. Furthermore, the T-shape leads to an overall reduction in the weight of the blade set.

One of the principal features of the invention is the provision of a blade assembly which is operative as a shear plate for a hair clipper set and which is of two-piece, laminated construction. This laminated construction facilitates manufacture of the blade assembly, reduces the weight of the assembly, and serves to insulate the associated blade member from heat and/or electricity.

Another of the principal features of the invention is the provision of a blade assembly of laminated, two-piece construction in which the blade member and blade carrier are detachably secured together in assembled relation. This construction permits easy separation of the blade assembly for cleaning, sharpening, or removal.

Yet another of the principal features of the invention is the provision of a blade assembly which is generally T-shaped and which permits use of the blade assembly in confined areas, such as the nostrils or ears, to remove superfluous hair. This construction also allows the operator to better see the cutting area and facilitates the free fall of hair. A reduction of the overall weight of the assembly and a savings in material also result.

Still another of the principal features of the invention is a generally T-shaped movable blade assembly for a hair clipper blade set, which movable blade assembly is of three-piece, laminated construction to permit easy separation of the associated cutting blade for cleaning, sharpening, and removal.

Another of the principal features of the invention is the provision of a hair clipper blade set which comprises a fixed blade assembly of two-piece, laminated construction and a movable blade assembly of three-piece, laminated construction. Ease of manufacture of the blade set as well as a reduction in the overall weight of the set results. Furthermore, separation of either the fixed blade or movable blade for cleaning, sharpening, or replacement is thus easily accomplished. The hair clipper blade set may be generally T-shaped to facilitate the use of the blade set in confined areas, such as the nostrils and ears.

Other features and advantages of the embodiments of the invention will become known by reference to the following description, the drawings, and appended claims.

BRIEF DESCRIPTION OF THE DRAWINGS

FIG. 1 is a side elevation view of a hair clipper having a blade set which embodies various of the features of the invention;

FIG. 2 is a partially broken away enlarged top plan view of the blade set of FIG. 1 showing the laminated movable blade assembly supported for reciprocative movement transverse the laminated fixed blade assembly;

FIG. 3 is an enlarged side elevation view of the blade set taken generally along line 3—3 of FIG. 2;

FIG. 4 is a partially broken away sectional view of the blade set taken generally along line 4—4 of FIG. 3;

Figure 5:
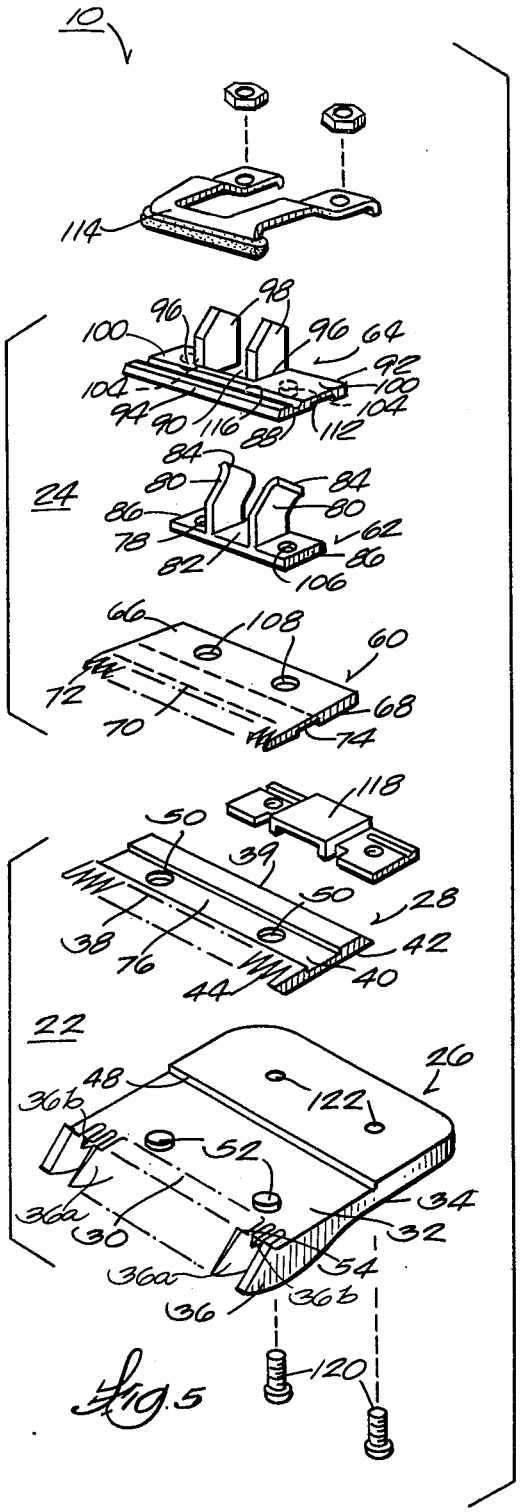
FIG. 5 is an exploded view of the blade set shown in FIG. 1.

Before explaining the embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

GENERAL DESCRIPTION

Shown in the drawings is a blade set 10 adapted for operative attachment to an electric hair clipper 12. While the associated hair clipper 12 may be variously constructed, in the illustrated embodiment (see FIG. 1), the hair clipper 12 includes a housing 14 in which an electric motor 16 is located. The blade set 10 is attached by suitable means (not shown) to one end of the clipper housing 14 and is operatively coupled with the motor 16 to cut hair. The blade set 10 may be fixedly attached to the clipper housing 14, or may be adjustably or detachably attached.

More particularly, and referring now principally to FIG. 5, the blade set 10 includes a fixed blade assembly 22, or shear plate, and a movable blade assembly 24 supported against the fixed blade assembly 22 (see FIGS. 2, 3 and 4) and driven by the motor 16 in a reciprocative path across the shear plate 22. This reciprocative movement of the movable blade 24 on and relative to the shear plate 22 is operative for cutting hair.

Reference is first made to the particular construction of the shear plate 22. In the illustrated embodiment (as is best seen in FIG. 5), the shear plate 22 is of two-piece, laminated construction. More particularly, the shear plate 22 includes a blade carrier 26 and a blade member 28 which are secured together in assembled relation.

In this construction, the blade carrier 26 is of unitary, molded construction. In this regard, the blade carrier 26 may be plastic, such as nylon, or metallic (ferrous or non-ferrous), or it may be a composition of the two.

The carrier 26 includes a forward edge 30 and spaced upper and lower surfaces, respectively, 32 and 34 which extend from the forward edge 30. In the illustrated and preferred embodiment, a series of comb teeth 36 project outwardly from the forward edge 30. As is best shown in FIG. 5, the series of comb teeth 36 includes a series of major teeth (designated **36*a*) and a series of minor or "skip" teeth (designated 36*b*) between the major teeth 36*a*. While the length of the skip teeth 36*b* relative to the length of the major teeth 36*a* may vary, in the illustrated embodiment, the skip teeth 36*b* are generally shorter than the major teeth 36*a*. The alternating arrangement of major teeth 36*a* and skip teeth 36*b* facilitates passage of the shear plate assembly 22** through thick hair.

The blade member 28 is of planar and relatively thin construction. It can be conveniently manufactured by machining suitably hardened, planar sheet stock. The blade member 28 includes a forward edge 38, a rearward edge 39 and spaced top and bottom surfaces, respectively, 40 and 42 which extend between the forward and rearward edges 38 and 39. A series of teeth 44 project outwardly from the forward blade member edge 38.

As can be best seen in FIG. 2, when the blade carrier 26 and the blade member 28 are in assembled relation, the blade teeth 44 generally overlie the comb teeth 36. The comb teeth 36 thus serve to guide the hair into position between the blade teeth 44.

It should be appreciated that the relative position of the blade member 28 on the blade carrier 26 can vary according to the particular hair cutting operations involved. For example, in relatively light cutting operations, in which the cutting blade teeth 44 are relatively small, the forward edge 38 of the blade teeth 44 can extend outwardly beyond the forward edge 30 of blade carrier 26. However, when heavier cutting operations are contemplated, and the size of the cutting teeth 44 increase accordingly, the forward edge 38 of the cutting blade teeth 44 can be positioned generally even with or slightly behind the forward edge 30 of the blade carrier 26 so that the blade carrier 26 lends support to the blade teeth 44. In the illustrated embodiment, the forward edge 38 of the blade teeth 44 generally overlies the forward edge 30 of the blade carrier 26.

In this general embodiment, the forward edges 30 and 38 can be generally upright or vertical and positioned in overlying alignment with each other to form a continuous, vertical forward edge for the shear plate assembly 22. However, in the particular embodiment illustrated (see FIG. 3), the forward edge 30 of the blade carrier 26 intermediate the comb teeth 36 is sloped or slanted in a forward direction between the lower carrier surface 34 and the upper carrier surface 32. In like fashion, the forward edge 38 of the blade member 28 intermediate the teeth 44 is sloped or slanted in a forward direction between its bottom surface 42 and its top surface 40. As can be seen in FIG. 3, when the blade carrier 26 and the blade member 28 are in their assembled relation, the forwardly sloped edges 30 and 38 are in a generally aligned, overlying relationship with each other to form a continuously sloped forward edge 46 for the shear plate assembly 22. This continuously sloped forward edge 46 acts to guide hair into position between the blade teeth 44 as the shear plate assembly 22 is moved through the hair.

The blade member 28 may be glued or otherwise fixedly attached to the blade carrier 26. However, in the illustrated embodiment, the blade member 28 and blade carrier 26 are detachably secured together in assembled relation. This construction permits the convenient separation of the blade member 28 from the blade carrier 26 for cleaning, sharpening, or replacement.

While the means for securing the blade carrier 26 and the blade member 28 together in assembled relation may vary, in the illustrated embodiment (as best seen in FIG. 5), at least one opening or bore 50 is drilled through the blade member 28, and a corresponding number of pins 52 projects upwardly from the upper carrier surface 32. In the illustrated embodiment, two circular bores 50 and two associated pins 52 are employed. However, a single square or triangular opening and an associated pin could be used. As can be seen in FIG. 2, when the blade teeth 44 overlie the comb teeth 36, the pins 52 are engaged in interference fit in the bores 50. It should be appreciated that the location of the bores 50 and the pins 52 on the blade member 28 and blade carrier 26 could be reversed, and the exact number of bores and pins 50 and 52 varied, and still achieve the same effect.

To complete the assembly of the blade member 28 upon the blade carrier, the blade carrier 26 includes an integral rearward shoulder 48 which projects upwardly from the upper carrier surface 32 in a spaced and parallel relation to the forward carrier edge 30. This rearward shoulder 48 engages the rearward blade edge 39 (see FIGS. 2 and 3) when the forward blade edge 38 overlies the forward carrier edge 30.

The securing means may also include a laterally aligned series of forward shoulders 54 (as can be best seen in FIGS. 3 and 5) which projects from the inner end portions of the comb teeth 36. These forward shoulders 54 engage the outer tips of each of the overlying blade teeth 44 when the blade member 28 and the blade carrier 26 are in properly aligned assembled relation with each other.

The securing means may consist of the interference fit between at least one bore and pin 50 and 52 in combination with blade engagement with either the rearward shoulder 48 or the forward shoulders 54. Alternately, both forward and rearward shoulders 54 and 48 may be used in combination with at least one bore and pin 50 and 52. Still alternately, a single square or triangular-shaped bore and associated pin (neither of which are shown) could be employed without the use of any shoulders. Still alternately, a trough or indentation could be formed in the upper carrier surface 32 to accommodate the snug placement of the blade member 28.

Reference is now made to the construction of the movable blade assembly 24 associated with the just described fixed blade assembly or shear plate 22. While various constructions are possible, in the illustrated embodiment, the movable blade assembly 24 is of three-piece, laminated construction and is generally arranged in the manner disclosed in my now pending application Ser. No. 916,511, filed June 19, 1978. More particularly, the movable blade assembly 24 includes a blade member 60, a yoke 62, and a shoe member 64 (see FIG. 5) which are detachably secured together in assembled relation (see FIGS. 2, 3 and 4) and which as a unitary assembly reciprocate transverse the shear plate assembly 22.

Referring principally to FIG. 5, the blade member 60, like the blade member 28, is of planar and relatively thin construction and can be conveniently manufactured by machining suitably hardened, planar sheet stock. The blade member 60 includes spaced upper and lower surfaces 66 and 68 and a forward edge 70. A series of teeth 72 project outwardly from the forward edge 70 and are adapted to cooperate with the shear plate teeth 44 to cut hair.

In the illustrated construction (as best shown in FIG. 3), the lower surface 68 of the movable blade assembly 60 bears against the top surface 40 of the shear plate blade member 28. Furthermore (and still referring principally to FIG. 3), the lower surface 68 of the movable blade member 60 includes a shallow transverse groove 74 which is parallel to the forward edge 70 of the blade member 60. Likewise, the top surface 40 of the blade member 28 similarly includes a shallow transverse groove 76. These grooves 74 and 76 provide a recess between the shear plate blade 28 and the movable blade 60 to provide clearance between the two blade members 28 and 60. In an alternate construction, either or both of the grooves 74 and 76 could be deleted.

The yoke member 62 associated with the movable blade assembly 24 is preferably constructed of electrically insulating material, such as plastic. As can best be seen in FIGS. 4 and 5, the yoke member 62 includes a main portion 78 which is clamped against the upper surface 66 of the blade member 60. The yoke member 62 is generally U-shaped and includes first and second laterally spaced walls 80 which extend upwardly from the main yoke portion 78 and which are joined at their lower end by a connecting web 82 or wall. Each wall 80 includes a rearwardly and upwardly extending edge portion 84 having an arcuately and laterally outwardly flaring terminal end portion.

The yoke member 62 also includes first and second flange portions 86 which respectively extend in laterally outward relation from the first and second walls 80 for overlying engagement with the upper surface 66 of the blade member 60. The flange portions 86 are also coplanar with the web 82.

The shoe member 64 associated with the movable blade assembly 24 is preferably constructed of metal, for example by die casting. The shoe member 64 includes a planar portion 88 overlying a portion of the upper surface 66 of the blade member 60. A notch 90 is located centrally of the planar shoe portion 88 and extends forwardly from the rearward edge 92 of the shoe member 64 toward the forward edge 94. The notch 90 includes two laterally or transversely spaced apart edges 96 extending in generally perpendicular relation to the forward and rearward edges 92 and 94 of the shoe member 64. First and second laterally spaced wall portions 98 extend upwardly from the laterally spaced edges 96 of the notch 90. These wall portions 98 are adapted to be located in laterally outwardly overlying relationship with the yoke walls 80 (see FIGS. 2 and 4), to provide structural support for the yoke walls 80.

The shoe member 64 further includes flange portions 100 which respectively extend laterally outwardly and in coplanar relationship from the edges 96 of the notch 90 and in overlying engagement with the flange portions 86 of the yoke member 62.

As can best be seen in FIGS. 4 and 5, means is provided for securing the movable blade member 60, the yoke member 62 and the shoe member 64 in assembled relationship. While various engagements can be employed, in the illustrated embodiment, the means comprises a pair of pins 104 which are integral with and extend downwardly from the flange portions 100 of the shoe member 64. The pins 104 are received through apertures 106 in the flanges 86 of the yoke member 62, being engaged in an interference fit in bores 108 in the upper surface 66 of the blade member 60.

Referring now to FIGS. 3 and 5, means is also provided for permitting separation of the shoe member 64 and the movable blade member 60 to facilitate replacement of the movable blade member 60. While various arrangements can be provided, in the illustrated construction, the shoe member 64 includes a recess 112 in its bottom surface to permit insertion of a tool between the shoe member 64 and the movable blade member 60 to pry the shoe member 64 and the blade member 60 apart.

Like the laminated construction of the shear plate assembly 22, the laminated construction of the illustrated movable blade assembly 24 provides for convenient cleaning, sharpening, or replacement of the associated blade member 60.

While there are various ways of supporting the movable blade assembly 24 for reciprocative movement across the shear plate assembly 22, in the illustrated embodiment (see FIGS. 2, 3, and 5), a thin spring 114 mates with a groove 116 formed in the upper surface of the shoe member 64. The spring 114 is secured in position by means of a bracket member 118 and a pair of screws 120 which extend through bores 122 in the blade carrier 26 of the shear plate assembly 22. The spring biases the entire movable blade assembly 24 against the top surface 40 of the shear plate blade 28. The spring 114 also supports the movable blade assembly 24 for reciprocative movement in a path generally parallel to the forward edge 38 of the shear plate blade 28.

Also in the illustrated embodiment, the motor 16 is generally arranged in the manner described in U.S. Pat. No. 3,992,778 issued Nov. 23, 1976. In this arrangement, as is shown in FIGS. 1 and 2, the motor 16 includes a central rotary drive shaft 18 having an eccentric conical end portion 20 which is freely rotatable with respect to the drive shaft 18. The eccentric end portion 20 extends between the yoke arms 80 (see FIG. 2) for engagement therebetween. Rotation of the drive shaft 18 and consequent eccentric movement of the eccentric end portion 20 will thus cause reciprocative movement of the movable blade assembly 24 transverse the shear plate or fixed blade assembly 22.

Figure 6:
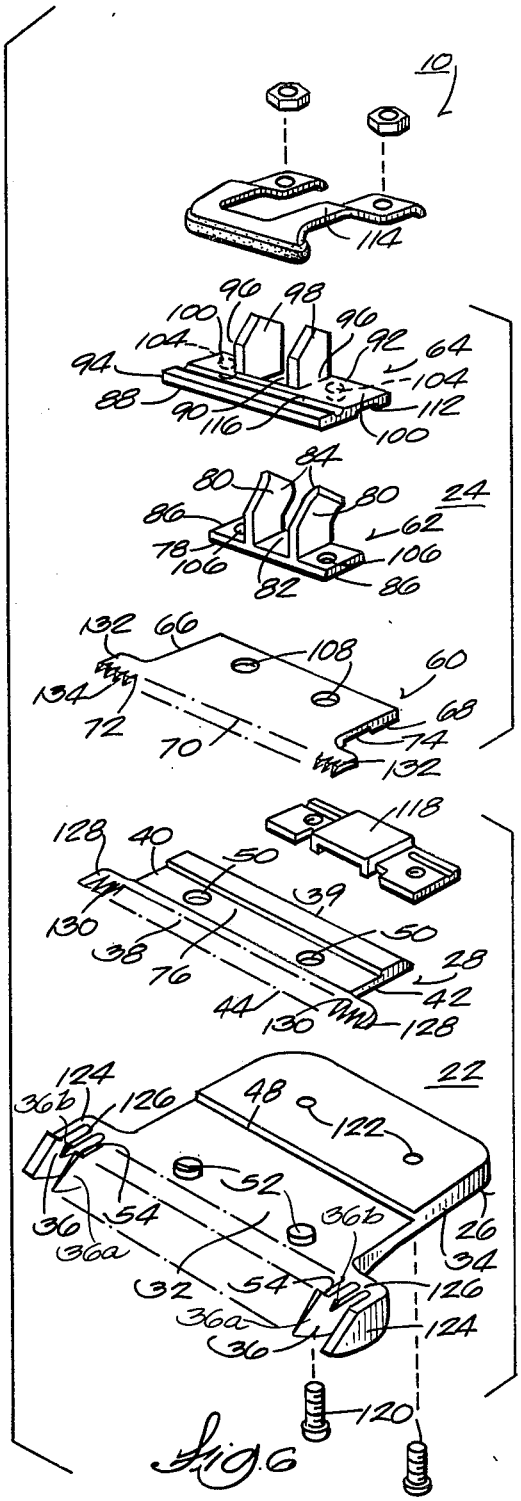
FIG. 6 is an exploded view of an alternate embodiment of the blade set shown in FIG. 1, in which the blade set is generally T-shaped.

Reference is now made to an alternate embodiment of the hair clipper blade set 10 which is shown in solid lines in FIG. 6 and in phantom lines in FIG. 2. Components which are common to the heretofore described embodiment are assigned common reference numerals. Like the first embodiment, the blade set 10 includes a laminated two-piece fixed blade assembly 22 and a laminated three-piece movable blade assembly 24 which is supported against the fixed blade assembly 22 for reciprocative movement across the fixed blade assembly 22. However, unlike the first described embodiment, both the fixed blade assembly 22 and the associated movable blade assembly 24 are generally T-shaped. This general T-shaped construction permits the use of the blade set 10 within relatively confined cutting areas, such as the nostrils or ears, to remove superfluous hair, while at the same time permitting use of the blade set 10 for normal hair cutting operations.

Referring first to the particular T-shaped construction of the fixed blade assembly 22, in the illustrated embodiment, mutually aligned extension bars 124 project laterally outwardly from opposite sides of the blade carrier 26 immediately adjacent to the forward carrier edge 30. Each of the extension bars 124 has a forward edge 126 which is generally aligned with the forward carrier edge 30. In addition, each of the extension bars 124 has a front to rear dimension which is narrow when compared to the corresponding front to rear dimension of the blade carrier 26. In the illustrated and preferred embodiment, the series of comb teeth 36 is substantially uniformly spaced across the forward edges 30 and 126 of the blade carrier 26 and its associated extension bars 124.

In like fashion, mutually aligned extension bars 128 project laterally outwardly from opposite sides of the blade member 28 immediately adjacent to the forward blade member edge 38. Like the extension bars 124 associated with the blade carrier 126, the blade member extension bars 128 of the blade member 28 have forward edges 130 which are generally aligned with the forward blade member edge 38, and the series of cutting teeth 44 is substantially uniformly spaced across the forward edges 38 and 130 of the blade member 28 and its associated extension bars 128. The blade member extension bars 128 have relatively narrow front to rear dimensions which are generally equal to the front to rear dimensions of the blade carrier extension bars 124. Thus, when the blade carrier 26 and the blade member 28 are in assembled relation, the blade member extension bars 128 overlie the blade carrier extension bars 124 (as best shown in phantom lines in FIG. 2), and the teeth 44 of the T-shaped blade member 28 generally overlie the comb teeth 36 of the associated T-shaped blade carrier 26.

Like the first described embodiment, the forward edges 30 and 126 of the T-shaped blade carrier 26 are uniformly sloped in a forward direction between the lower carrier surface 34 and the upper carrier surface 32. Similarly, the forward edges 38 and 130 of the blade member 28 are uniformly sloped in a forward direction between the lower blade surface 42 and the top blade surface 40. When the T-shaped blade carrier 26 and T-shaped blade member 28 are in assembled relation, the respective forward edges form a continuously sloped forward edge for the entire T-shaped fixed blade assembly 22.

While the T-shaped movable blade assembly 24 associated with the just described T-shaped fixed blade assembly 22 may be variously constructed, in the illustrated embodiment, the heretofore described laminated three-piece construction is illustrated. In this construction, the blade member 60 includes mutually aligned extension bars 132 which project laterally outwardly from opposite sides of the blade member 60 immediately adjacent to its forward edge 70. These mutually aligned bars 132 have forward edges 134 which are generally laterally aligned with the forward edge 70 of the blade member 60, and the series of teeth 72 is substantially uniformly spaced across the forward edges 70 and 134 of the blade member 60 and its associated extension bars 132. The remaining construction of the associated yoke member 62 and shoe member 64 as well as the assembled relationship between the blade member 60, the yoke member 62 and the shoe member 64, is identical to that as just described.

When the T-shaped movable cutting blade assembly 24 is supported against the T-shaped fixed blade assembly 22 for a reciprocative movement transverse the T-shaped fixed blade assembly 22, the teeth 72 of the movable blade assembly 24 cooperate with the teeth 44 of the fixed blade assembly 22 to cut hair. Furthermore, the narrow extension bars 124, 128 and 132 may be used within relatively confined areas, such as the nostrils or ears, with the teeth 44 and 72 on the extension bars 128 and 132 operating with the same accuracy and lack of cramping or undue friction as the teeth within the normal range of reciprocation of the respective blades.

Various of the features of the invention are set forth in the following claims.

I claim:

1. A blade assembly operative as a shear plate for a hair clipper blade set and comprising a blade carrier including a forward edge and a series of comb teeth which are outwardly projecting from said forward edge, said blade carrier also including spaced upper and lower surfaces extending from said forward edge, said forward edge of said blade carrier sloping from said lower surface forwardly towards said upper surface, a blade member having a forward edge and a series of teeth outwardly projecting from said blade member forward edge and generally overlying said comb teeth when said blade member and said blade carrier are in assembled relation, said blade member also including top and bottom surfaces extending from said forward edge, said forward edge of said blade member slopping from said bottom surface forwardly toward said top surface and, together with said slopping forward edge of said blade carrier, forming a continuously slopping forward edge for said blade assembly when said blade member and said blade carrier are in assembled relation, and means for securing together said blade carrier and said blade member in assembled relation.

* * * * *

UNITED STATES PATENT AND TRADEMARK OFFICE

CERTIFICATE OF CORRECTION

PATENT NO. : 4,328,616

DATED : May 11, 1982

INVENTOR(S) : Matthew L. Andis

It is certified that error appears in the above-identified patent and that said Letters Patent are hereby corrected as shown below:

In the Abstract, line 9, "theteeth" should be -- the teeth --.

Column 2, line 48, "T-shaped" should be -- T-shape --.

Signed and Sealed this

*Nineteenth* Day of *March 1985*

[SEAL]

*Attest:*

DONALD J. QUIGG

*Attesting Officer*

*Acting Commissioner of Patents and Trademarks*